US008939285B2

(12) United States Patent
Trontel et al.

(10) Patent No.: US 8,939,285 B2
(45) Date of Patent: Jan. 27, 2015

(54) DISPLAY PACKAGE FOR STEERING WHEEL LOCK

(76) Inventors: Gerald J. Trontel, Sharpsville, PA (US); Alan P. Brandt, Hermitage, PA (US)

( * ) Notice: Subject to any disclaimer, the term of this patent is extended or adjusted under 35 U.S.C. 154(b) by 32 days.

(21) Appl. No.: 13/608,258

(22) Filed: Sep. 10, 2012

(65) Prior Publication Data

US 2013/0062240 A1 Mar. 14, 2013

Related U.S. Application Data

(60) Provisional application No. 61/533,249, filed on Sep. 11, 2011.

(51) Int. Cl.
*B65D 85/68* (2006.01)
*B65D 73/00* (2006.01)

(52) U.S. Cl.
CPC ..... *B65D 73/0064* (2013.01)
USPC ..... 206/335; 206/779; 206/471; 206/580

(58) Field of Classification Search
USPC ..... 206/779, 335, 461, 462, 463, 775, 776, 206/780, 782, 471, 495, 580, 806, 459.5, 206/223, 349, 515; 53/447, 531, 540
See application file for complete search history.

(56) References Cited

U.S. PATENT DOCUMENTS 4,019,632 A 4/1977 Greenlee
4,493,416 A * 1/1985 Steinman ..... 206/315.11
4,899,877 A 2/1990 Keirnan
5,730,290 A 3/1998 Futo
5,803,253 A 9/1998 Zakarian
5,865,502 A * 2/1999 Ayers et al. ..... 297/188.06
6,467,617 B1 10/2002 Chen
6,766,906 B2 7/2004 Charng
6,820,742 B1 11/2004 Chen
6,899,222 B2 * 5/2005 Jones et al. ..... 206/305
7,131,535 B2 11/2006 Hernandez, Jr. et al.
7,344,026 B2 3/2008 Melgaard
7,392,906 B2 7/2008 Yu
7,537,115 B2 5/2009 Weaver
7,568,578 B2 * 8/2009 Berman ..... 206/335
7,624,865 B2 12/2009 Pendergraph et al.
7,789,234 B2 9/2010 Clark
2002/0095959 A1 * 7/2002 Meekma et al. ..... 70/209
2003/0074934 A1 * 4/2003 Moreton ..... 70/209

* cited by examiner

*Primary Examiner* — Jacob K Ackun
*Assistant Examiner* — Jenine Pagan
(74) *Attorney, Agent, or Firm* — Wayne D. Porter, Jr.

(57) ABSTRACT

A display package for containing and displaying a steering wheel locking device having an elongate central tubular rod member and first and second pairs of spaced hooks connected to the tubular rod member includes a pair of generally equally sized, equally shaped front and rear panels that are superimposed and joined together to partially enclose a steering wheel locking device, the front and rear panels being configured to generally conform to the shape of the steering wheel locking device. Multiple packages can be stacked such that portions of adjacent steering wheel locks nest partially within one another and reduce otherwise wasted space between adjacent packages.

15 Claims, 5 Drawing Sheets

DISPLAY PACKAGE FOR STEERING WHEEL LOCK

REFERENCE TO PROVISIONAL APPLICATION

The present application incorporates by reference and claims priority from U.S. provisional application Ser. No. 61/533,249, entitled Display Package for Steering Wheel Lock, filed Sep. 11, 2011 by Gerald J. Trontel and Alan P. Brandt.

BACKGROUND OF THE INVENTION

1. Field of the Invention

The present invention is related to suspension-type display packages for steering wheel locks, where the packaging provides a nestable aspect that allows packages to be stacked efficiently and minimizes the volume of space taken in the stacking.

2. Description of the Prior Art

Suspension-type product packages are well-known, and typically include an upper end area having an opening for receiving a hook, rod or the like that extends forwardly from a support, such as a vertical wall of a display. Typically, a suspension-type package is constructed such that the product is secured to a forwardly facing surface defined by a vertically oriented panel of the package, and the opening for the hook or the like is formed in an upper area of the panel.

A number of patents disclose display packages of the general type discussed above. These packages generally have front and rear panels that conform to the shape of an article to be displayed with a portion of the article projecting from the package. Typically, at least one of the panels has an opening through which a potential purchaser can have access to a portion of the article for purposes of touching or operating it.

For example, U.S. Pat. No. 5,803,253 to Zakarian discloses a tool display packaging in which the head end of an adjustable wrench is held between panels that enclose the wrench. The panels have an opening at one end through which a wrench handles projects. Aligned openings enable the package to be suspended from a hook. The panels include openings through which a potential purchaser can contact and move a rotatable portion of the wrench in order to see the wrench jaws open and close. The package includes a "display wall" that permits identifying indicia to be printed or to which labels can be affixed.

U.S. Pat. No. 4,899,877 to Kiernan discloses a tool-holding and displaying package in which front and rear panels are molded to the shape of a portion of the device contained in the package and in which a card or other printed graphic material can be placed between the front and rear panels.

Designing display packages for steering wheel locks is particularly troublesome because of the shape of the steering wheel locks. For example, U.S. Pat. Nos. 5,735,149; 6,230,527; and 6,694,784, as well as design U.S. Pat. No. Des. D521,357, the disclosures of which are incorporated herein by reference, all teach steering wheel locks and the use of connectors which attach to the steering wheel. These connectors provide a problem in providing packaging for them because of their protrusion, especially when the packages are stacked together.

SUMMARY OF THE INVENTION

The present invention permits objects such as steering wheel locks to be displayed as suspension-type packages, but provides means for stacking the packages to minimize the volume of space taken in the stacking. The display package according to the invention includes a transparent front panel that conforms to the shape of the lock housing and its handle. The package also includes a transparent rear panel of same size and shape as front panel that conforms to the shape of the handle and a portion of steering wheel-engaging hooks. The front and rear panels are superimposed and connected together about their periphery so as to retain a display card, if desired, and most of the steering wheel lock therebetween.

The invention includes a plurality of cutouts in the superimposed front and rear panels and the display card. The cutouts are coincident so as to create one or more openings that can receive one or more rods, hooks, or other members by which the package can be suspended. Preferably, the openings are horizontally aligned and equally spaced. Also, it is preferred that the center opening be in the form of a traditional "keyhole" while the openings on either side of the center opening are round. Further, it is preferred that the openings be laterally arranged on the front and rear panels so that the completed package will hang vertically from the rod, hook, or other member by which the package is suspended.

Selected edges of the superimposed front and rear panels define an opening through which the handle projects along an axis parallel to the plane in which most of the panels lie. The rear panel contains openings through which a portion of the hooks project. The aligned openings are toward the end of the panels that is opposite the opening through which the handle projects.

BRIEF DESCRIPTION OF THE DRAWINGS

The foregoing and other features and advantages of the present invention will become apparent to those skilled in the art to which the present invention relates upon reading the following description with reference to the accompanying drawings, in which like reference characters refer to like elements through the different figures and in which.

DESCRIPTION OF THE PREFERRED EMBODIMENT

The display package of the present invention permits objects such as steering wheel locks to be displayed as suspension-type packages, but provides means for stacking the packages to take less space.

Figure 1:
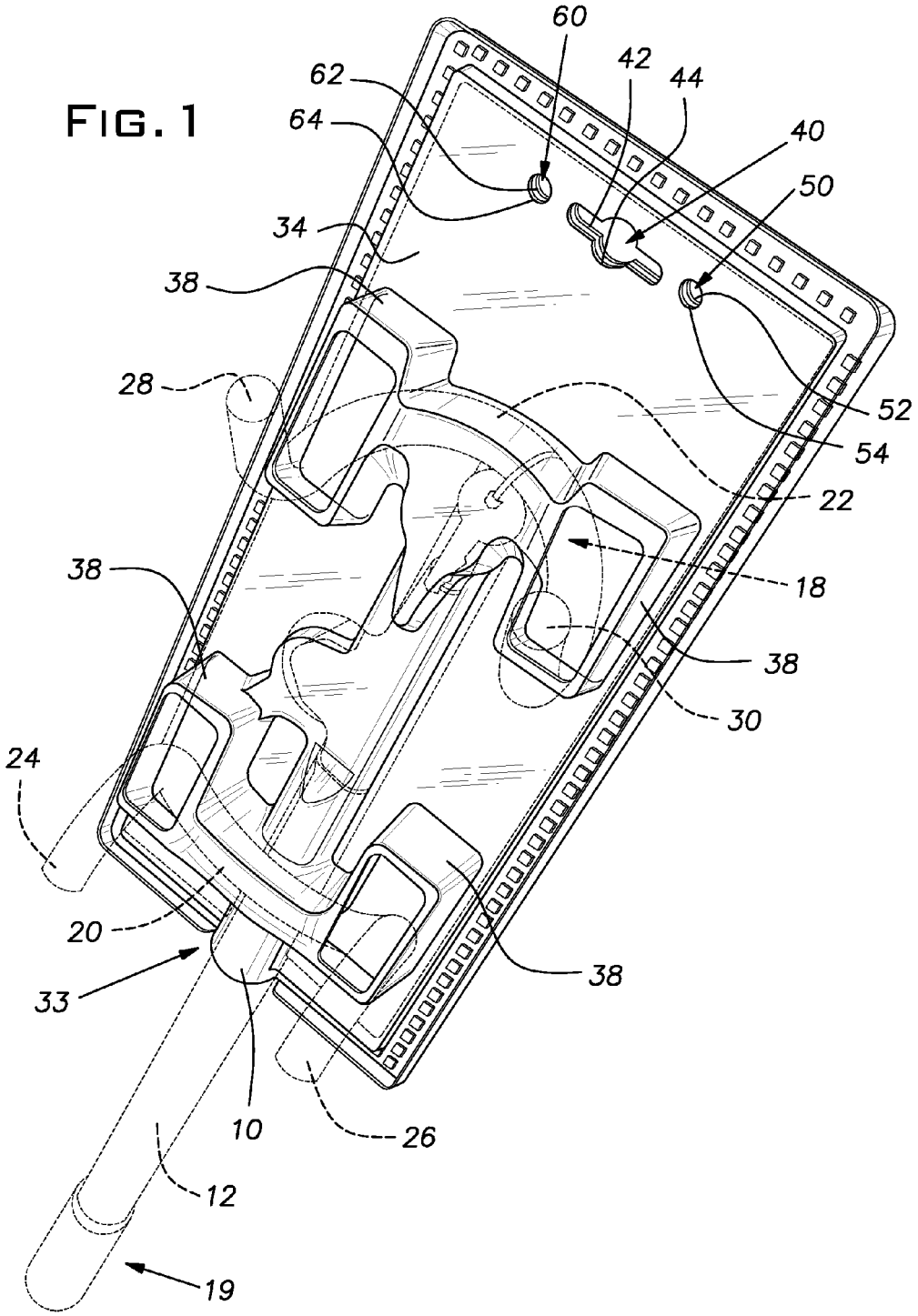
FIG. 1 is a rear perspective view of a display package according to the invention showing a steering wheel lock in dashed lines being contained within the package.
Figure 6:
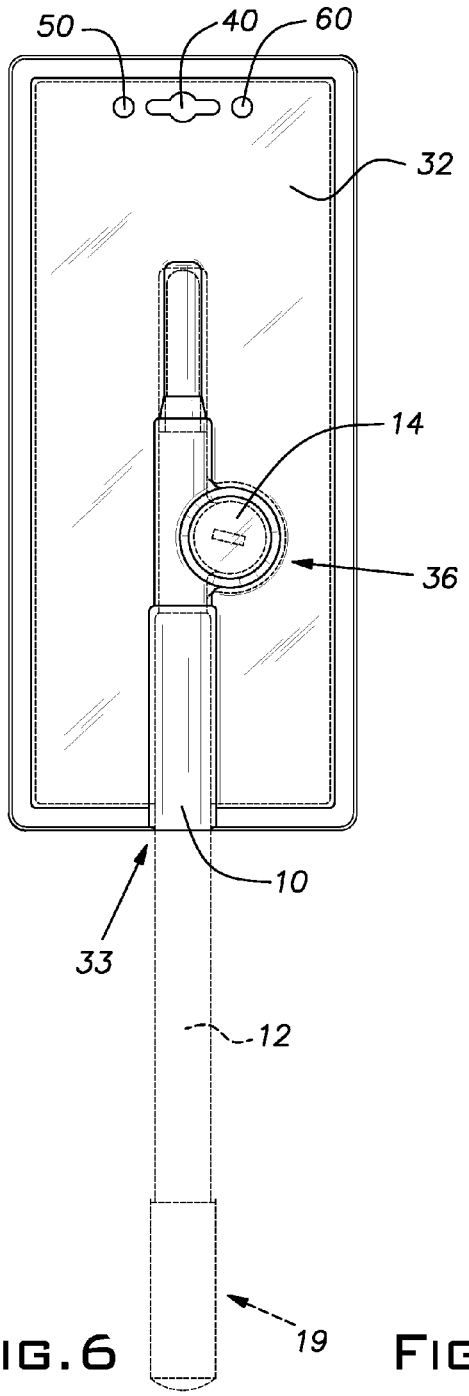
FIG. 6 is a front plan view of the display package of FIG. 1.
Figure 7:
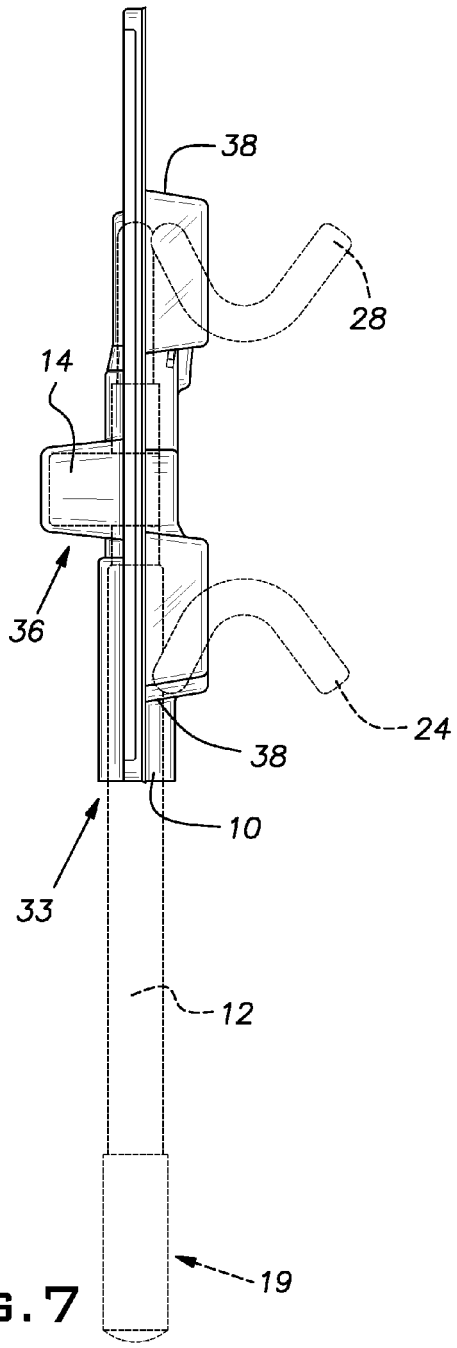
FIG. 7 is a side elevation view of the left side of the display package of FIG. 1.

Referring now to the drawings wherein the showings are for the purpose of illustrating a preferred embodiment of the invention only and not for the purpose of limiting same, in FIG. 1 there is shown a perspective view of a display package containing a steering wheel lock according to the present invention. Broadly stated, the steering wheel lock is comprised of an elongated tubular member 10, an elongated rod member 12, which is telescopically received within the tubular member 10, and a lock housing 14 (shown in FIG. 6). Wheel rim hooks 16 and 18 for engaging opposed portions of a steering wheel from the inside thereof are provided on the tubular member 10. The lock housing 14 includes means to position and lock the rod member 12 stationary with respect to the tubular member 10 at any one of a plurality of axially spaced positions. The rod member 12 includes a projected portion 19 extending beyond the first rim hook 16 sufficiently to come into contact with the vehicle interior when the steering wheel is turned and thereby to block complete rotation of the wheel.

The wheel rim hooks 16, 18 have a generally U-shaped center portion 20, 22 and terminate in hook-like portions 24, 26, 28, 30 having a reverse curvature to engage the steering wheel. When packaging the steering wheel locks, it is the terminus ends of the hooks that are problematic in stacking the packaging.

The display package includes a transparent front panel 32, which has a raised portion 36, which conforms to the shape of the lock housing 14 and the handle. The package also includes a transparent rear panel 34 of same size and shape as front panel 32 that conforms to the shape of the handle and openings 38 for the terminus ends 24, 26, 28, 30 of the hooks 16, 18. The shape of the openings 38 is not critical. The openings 38 are illustrated as rectangular, but they could be other geometric shapes, such as ovals. The shape must function to allow the terminus ends 24, 26, 28, and 30 to pass through and protrude from the package. It may be desirable to have a raised wall that surrounds the opening to strengthen the opening and prevent premature opening of the packaging due to tearing (accidental or otherwise). The front and rear panels 32, 34 are superimposed and connected together about their periphery so as to retain a display card (not shown) and most of the steering wheel lock therebetween. The display card within the package as described and may be printed or graphic material with instructions, advertising material and/or other necessary information.

The invention includes a plurality of openings 40, 50, 60 in the superimposed front and rear panels 32, 34 and the display card, if used. When front and rear panels 32, 34 are joined, coincident cutouts 42, 44, 52, 54, 62, 64 form openings 40, 50, 60 that receive a rod, hook, or other member by which the package can be suspended (FIG. 1). Preferably, the openings 40, 50, 60 are horizontally aligned and opening 40 is centered on the package, while openings 50, 60 are equidistant from opening 40. Also, it is preferred that center cutouts 42, 44 form a traditional "keyhole" opening 40 and cutouts 52, 54 and 62, 64 form round openings, 50 and 60, respectively. The aligned openings 40, 50, 60 are toward the end of the panels that is opposite the opening through which the handle projects.

Figure 2:
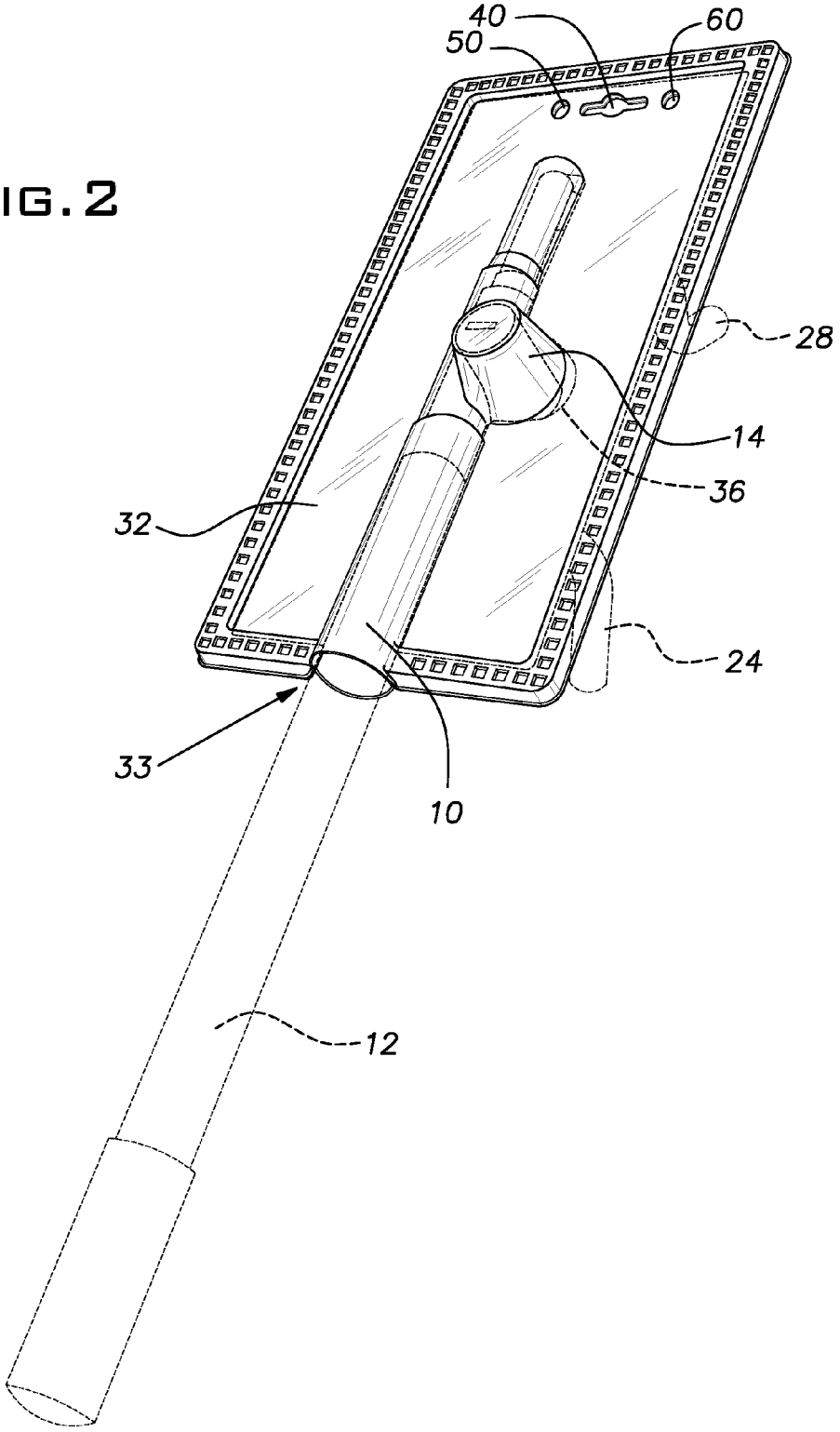
FIG. 2 is a front perspective view of the display package of FIG. 1.
Figure 4:
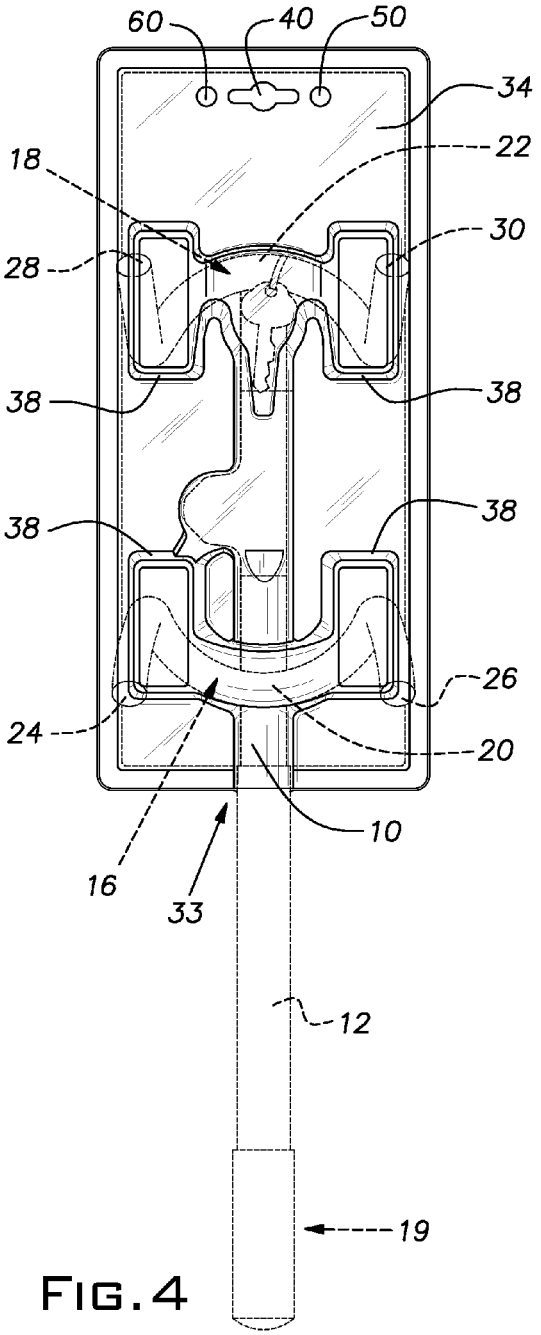
FIG. 4 is a front plan view of the display package of FIG. 1.
Figure 5:
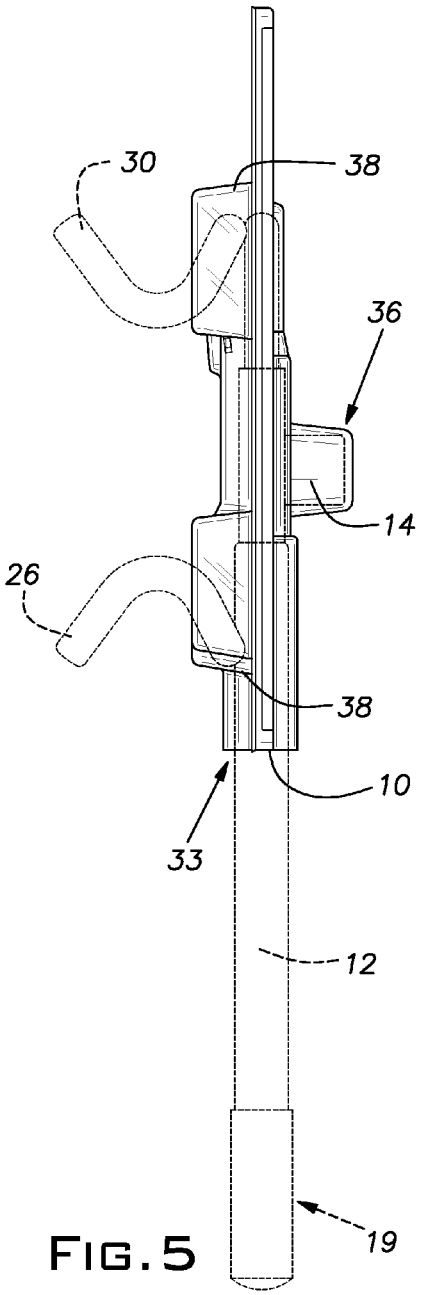
FIG. 5 is a side elevation view of the right side of the display package of FIG. 1.

Selected edges of the superimposed front and rear panels 32, 34 define an opening 33 through which the handle projects along an axis parallel to the plane in which most of the panels lie. The rear panel 34 contains four openings 38 through which the terminus portions 24, 26, 28, 30 of the hooks project. In a preferred form of the invention, the front and real panels 32, 34 are each formed in one operation from a single sheet of formable plastic sheet material. The front and back sheets can then be joined by welding the sheets together using spot welds (FIG. 2) or a continuous weld (FIGS. 1, 4, 6), although the joining is not critical and could be joined by any method known to those skilled in the art, including stapling, gluing, or any other known technique. Several different types of plastic material may be used to construct the packages since the particular plastic material used is not critical.

Figure 3:
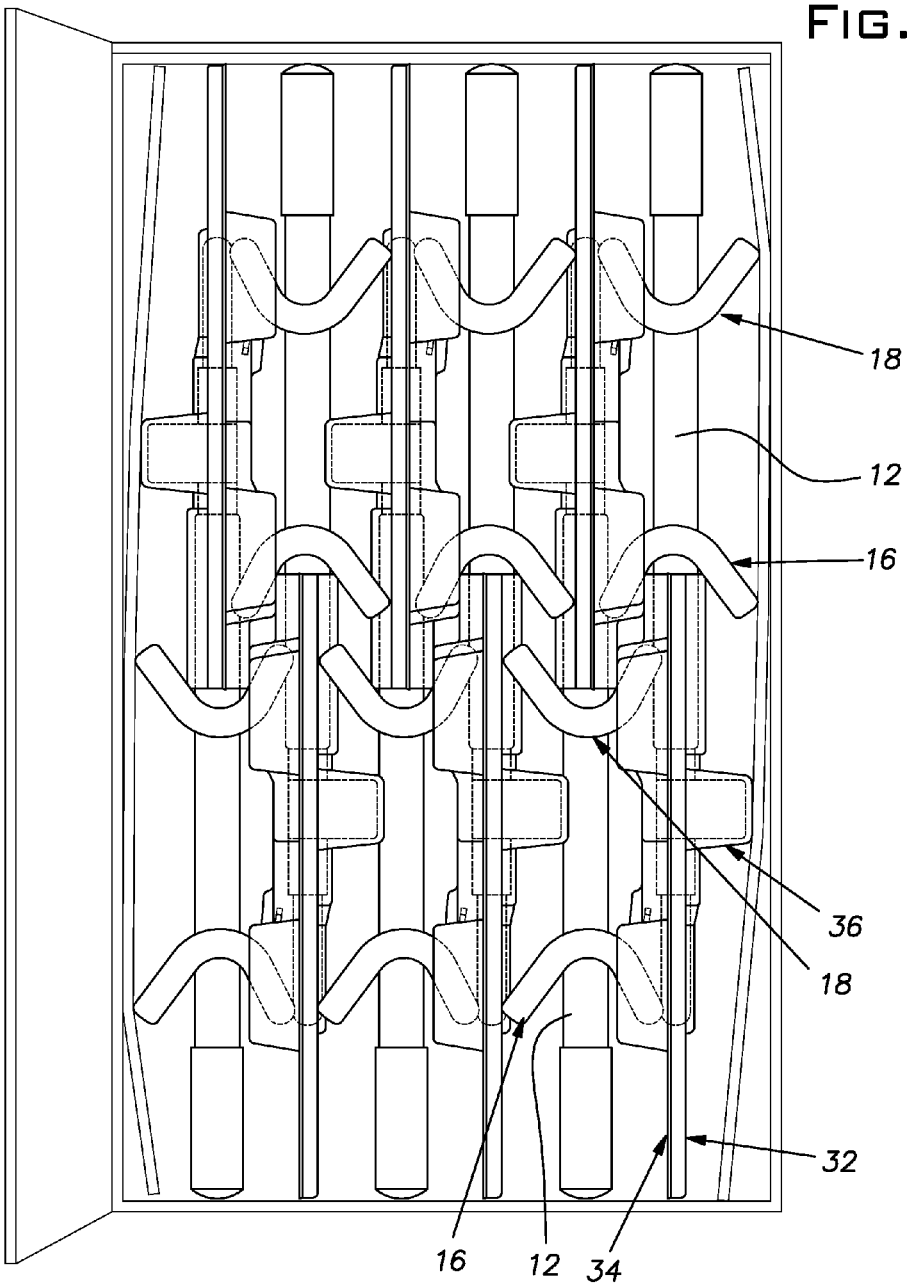
FIG. 3 is a side elevation view of several display packages of FIG. 1 in a nested configuration.

As can be seen in FIG. 3, when the packages are stacked rear to rear and then front to front and with the ends opposite in an alternating fashion, and then they are stacked back to back, with the ends opposite, the hooks 16, 18 will be located on either side of the rod member 12. Thus, they can be placed in close proximity and make efficient use of space.

Although the invention has been described in detail with reference to particular examples and embodiments, the examples and embodiments contained herein are merely illustrative and are not an exhaustive list. Variations and modifications of the present invention will readily occur to those skilled in the art. The present invention includes all such modifications and equivalents.

What is claimed is:

1. A display package for containing and displaying a steering wheel locking device that is of sufficient length to come into contact with portions of the interior of a motor vehicle to prevent complete rotation of the steering wheel when the steering locking device is deployed, the steering wheel locking device having a central tubular rod member having an elongated passageway extending along its axis therethrough and having a distal end that can function as a handle, a telescoping inner shaft extensibly mounted within the passageway of the central tubular rod along a common longitudinal axis, a lock that engages the inner shaft and the tubular member and prevents axial movement between the inner shaft and the tubular member, a lock housing joined to the tubular member and containing the lock, a first pair of spaced hooks connected to the tubular member, the first pair of hooks having a generally U-shaped spine and terminating in a pair of arcuate hook-like ends having reverse curvature to engage portions of a steering wheel, and a second pair of spaced hooks connected to the inner shaft, the second pair of hooks having a generally U-shaped spine and terminating in a pair of arcuate hook-like ends having reverse curvature to engage portions of a steering wheel, the second set of hooks having an inverted orientation with respect to the first set of hooks, comprising:

a pair of generally equally sized, equally shaped front and rear panels that are superimposed and joined together to partially enclose a steering wheel locking device, the front and rear panels being configured to generally conform to the shape of the steering wheel locking device;

the rear panel having four shaped openings through which the arcuate hook-like ends of the first and second pairs of hooks can protrude outwardly from the rear panel;

the front and rear panels cooperating to form an opening through which the distal end of the central tubular rod member can extend outwardly such that the distal end of the central tubular rod member is exposed and is not enclosed by the package; and wherein when multiple packages are stacked rear to rear and then front to front with the ends opposite in an alternating fashion, and then stacked back to back, with the ends opposite, the tubular rod member of one steering wheel locking device will rest in the space between the hooks of an adjacent steering wheel locking device such that the hooks will be located on either side of the tubular rod member whereby portions of adjacent steering wheel locks nest partially within one another and reduce otherwise wasted space between adjacent packages.

2. The display package of claim 1, wherein the front and rear panels are each formed of single sheets of formable plastic sheet material.

3. The display package of claim 2, wherein the plastic sheet material is transparent.

4. The display package of claim 3, further including a display card enclosed between the front and rear panels.

5. The display package of claim 1, wherein the shaped openings in the rear panel are generally rectangular.

6. The display package of claim 1, wherein the shaped openings in the rear panel are generally circular.

7. The display package of claim 1, further comprising a raised wall that surrounds the shaped openings to strengthen the shaped openings and prevent premature opening of the package due to tearing.

8. The display package of claim 1, wherein the front and rear panels have at least one pair of aligned cutouts located on a portion of the panels opposite a portion containing the opening through which the portion of the tubular rod member extends, the cutouts creating suspension openings that permit the package to hang from a peg or similar commercial display support.

9. The display package of claim 8, wherein the suspension openings in use are horizontally aligned.

10. The display package of claim 8, wherein three generally aligned suspension openings are provided, the outermost suspension openings being round and the central suspension opening being keyhole-shaped, the suspension openings in use being horizontally aligned.

11. The display package of claim 1, wherein the front and rear panels are joined about their periphery by welds, staples, or glue.

12. A display package for containing and displaying a steering wheel locking device that is of sufficient length to come into contact with portions of the interior of a motor vehicle to prevent complete rotation of the steering wheel when the steering locking device is deployed, the steering wheel locking device having a central tubular rod member having an elongated passageway extending along its axis therethrough and having a distal end that can function as a handle, a telescoping inner shaft extensibly mounted within the passageway of the central tubular rod along a common longitudinal axis, a lock that engages the inner shaft and the tubular member and prevents axial movement between the inner shaft and the tubular member, a lock housing joined to the tubular member and containing the lock, a first pair of spaced hooks connected to the tubular member, the first pair of hooks having a generally U-shaped spine and terminating in a pair of arcuate hook-like ends having reverse curvature to engage portions of a steering wheel, and a second pair of spaced hooks connected to the inner shaft, the second pair of hooks having a generally U-shaped spine and terminating in a pair of arcuate hook-like ends having reverse curvature to engage portions of a steering wheel, the second set of hooks having an inverted orientation with respect to the first set of hooks, comprising:

a pair of generally equally sized, equally shaped, transparent front and rear panels formed of single sheets of formable plastic sheet material that are superimposed and joined together about their periphery to partially enclose a steering wheel locking device, the front and rear panels being configured to generally conform to the shape of the steering wheel locking device, the front and rear panels being joined about their periphery by welds, staples, or glue;

a display card enclosed between the front and rear panels;

the rear panel having four shaped openings through which the arcuate hook-like ends of the first and second pairs of hooks can protrude outwardly from the rear panel, the four shaped openings being generally rectangular or generally circular;

a raised wall that surrounds the shaped openings to strengthen the shaped openings and prevent premature opening of the package due to tearing;

the front and rear panels having at least one pair of aligned cutouts located on a portion of the panels opposite a portion containing the opening through which the distal end of the tubular rod member extends, the cutouts creating suspension openings that permit the package to hang from a peg or similar commercial display support;

the front and rear panels cooperating to form an opening through which the distal end of the central tubular rod member can extend outwardly such that the distal end of the central tubular rod member is exposed and is not enclosed by the package; and wherein when multiple packages are stacked rear to rear and then front to front with the ends opposite in an alternating fashion, and then stacked back to back, with the ends opposite, the tubular rod member of one steering wheel locking device will rest in the space between the hooks of an adjacent steering wheel locking device such that the hooks will be located on either side of the tubular rod member whereby portions of adjacent steering wheel locks nest partially within one another and reduce otherwise wasted space between adjacent packages.

13. The display package of claim 12, wherein the suspension openings in use are horizontally aligned.

14. The display package of claim 13, wherein three generally aligned suspension openings are provided, the outermost suspension openings being round and the central suspension opening being keyhole-shaped, the suspension openings in use being horizontally aligned.

15. A method of stacking display packages, comprising the steps of:

providing multiple display packages ac claimed in claim 1 each having:

a pair of generally equally sized, equally shaped front and rear panels that are superimposed and joined together to partially enclose a steering wheel locking device, the front and rear panels being configured to generally conform to the shape of the steering wheel locking device;

the rear panel having four shaped openings through which arcuate hook-like ends of first and second pairs of hooks can protrude outwardly from the rear panel; and the front and rear panels cooperating to form an opening through which a distal end of a central tubular rod member can extend outwardly such that the distal end of the central tubular rod member is exposed and is not enclosed by the package;

placing a first display package such that its rear panel is exposed and unobstructed;

placing a second display package with its rear panel facing the rear panel of the first display package and then rotating it 180 degrees such that the distal end of the central tubular rod member of the first display package is pointing in the opposite direction of the distal end of the central tubular rod member of the second display package and the rear panel of the first display package is in contact with and facing the rear panel of the second display package, whereby the front panel of the second display package is exposed and unobstructed;

placing a third display package with its front panel facing the front panel of the second display package and then rotating it 180 degrees such that the distal end of the central tubular rod member of the second display package is pointing in the opposite direction of the distal end of the central tubular rod member of the third display package and pointing in the same direction as the distal end of the central tubular rod member of the first display package, and the front panel of the second display package is in contact with and facing the front panel of the third display package, whereby the rear panel of the third display package is exposed and unobstructed; and placing a fourth display package in the same manner as the second display package and repeating the aforementioned steps until all display packages are stacked or no space is available for additional display packages.

* * * * *

UNITED STATES PATENT AND TRADEMARK OFFICE

CERTIFICATE OF CORRECTION

PATENT NO. : 8,939,285 B2
APPLICATION NO. : 13/608258
DATED : January 27, 2015
INVENTOR(S) : Gerald J. Trontel and Alan P. Brandt It is certified that error appears in the above-identified patent and that said Letters Patent is hereby corrected as shown below:

In The Claims

Column 6, line 35 (Claim 15): "ac claimed in claim 1" should be deleted.

Signed and Sealed this
Twenty-second Day of March, 2016

Michelle K. Lee

Michelle K. Lee
*Director of the United States Patent and Trademark Office*